US005645307A

United States Patent [19]

Wengler

[11] Patent Number: 5,645,307

[45] Date of Patent: Jul. 8, 1997

[54] STRAP-STYLE ARTICLE CARRIER

[75] Inventor: James J. Wengler, Minneapolis, Minn.

[73] Assignee: Robert Davidson, Southport, Conn.

[21] Appl. No.: 686,492

[22] Filed: Jul. 25, 1996

Related U.S. Application Data

[63] Continuation of Ser. No. 314,223, Sep. 28, 1994, Pat. No. 5,558,382.

[51] Int. Cl.[6] ..... A45F 5/10; B65D 63/18

[52] U.S. Cl. ..... 294/157; 294/165

[58] Field of Search ..... 294/31.2, 74, 138, 294/147, 149–157, 165, 170; 150/157; 190/115; 206/319; 224/214, 250; 440/76, 77, 113

[56] References Cited

U.S. PATENT DOCUMENTS

| | | | |
|---|---|---|---|
| 187,716 | 2/1877 | Kirk | 294/165 |
| 473,531 | 4/1892 | Stone | 294/157 |
| 562,021 | 6/1896 | Phelan | 294/155 |
| 799,793 | 9/1905 | Kinsella | 294/155 |
| 925,986 | 6/1909 | Blackburn | 294/157 |
| 1,187,496 | 6/1916 | Bullock | 294/155 |
| 1,847,501 | 3/1932 | Stahler | 294/157 |
| 2,422,235 | 6/1947 | Greene | 294/138 |
| 2,434,784 | 1/1948 | Bardin | 150/157 |
| 2,475,135 | 7/1949 | Haven | 150/157 |
| 2,498,113 | 2/1950 | Milner | 150/157 |
| 2,541,449 | 2/1951 | Vickers | 294/149 |
| 2,575,749 | 11/1951 | Cross | 206/319 |
| 2,978,154 | 4/1961 | Kailey | 294/154 |
| 3,092,223 | 6/1963 | Martin | 294/154 X |
| 3,172,586 | 3/1965 | Lu | 294/155 |
| 3,942,636 | 3/1976 | Matsuyama et al. | 294/156 X |
| 4,114,838 | 9/1978 | Knauf | 294/147 |
| 4,469,363 | 9/1984 | Kalla | 294/154 |
| 4,556,245 | 12/1985 | Gruenwald | 294/31.2 |
| 4,754,996 | 7/1988 | Tecca et al. | 294/151 |
| 4,804,218 | 2/1989 | Hilliard | 294/157 X |
| 4,828,310 | 5/1989 | Schmidt, Jr. et al. | 294/153 |
| 5,137,481 | 8/1992 | Wengler | 440/77 |
| 5,297,835 | 3/1994 | Wengler | 294/146 |

FOREIGN PATENT DOCUMENTS

| | | | |
|---|---|---|---|
| 747280 | 1/1944 | Germany | 440/113 |

*Primary Examiner*—Johnny D. Cherry
*Attorney, Agent, or Firm*—James V. Harmon

[57] ABSTRACT

The invention provides an article carrier for heavy articles such as an outboard motor. It includes a pair of article-encircling loops including a rear strap loop for encircling the stern portion of an outboard motor and a front strap loop encircling the front portion of the motor. Each of the loops is positioned during use in an inclined plane such that the rear strap loop projects rearwardly from the handle at an oblique angle and the front strap loop projects forwardly at an oblique angle whereby the loops lie in inclined planes and encircle the motor obliquely when in place on the motor housing. A handle formed from a flexible member is connected to the article carrier at the top of the motor during use to provide a hand grip for the carrier. Releasable fasteners are secured to at least one of the loops for holding the loops in place on the motor during use. The strap assembly includes a tension-absorbing portion at the top of the strap assembly, which can either be a portion of the straps themselves or a separate strong, flexible connecting element such as a piece of fabric webbing that is connected to upper portions of the article-encircling straps for holding the straps in place at the top of the motor.

13 Claims, 2 Drawing Sheets

STRAP-STYLE ARTICLE CARRIER

This is a continuation of application Ser. No. 08/314,223, filed Sep. 28, 1994, now U.S. Pat. No. 5,558,382.

FIELD OF THE INVENTION

This invention relates to a strap-style carrier for articles and particularly a strap-style carrier that is suited for lifting and transporting a heavy item such as an outboard motor.

BACKGROUND OF THE INVENTION

My two prior U.S. Pat. Nos. 5,137,481 and 5,297,835 describe article carriers that are excellent for lifting, transporting and positioning an outboard motor. This is a particularly difficult job, especially if a boat onto which the motor is being placed is bobbing about in a heavy sea. While the patented items produce outstanding results, it is an object of the present invention to provide a strap-style carrier that is simpler in construction, easier to produce, lower in cost, and still has a neat appearance. It is a further object to provide a strap-style carrier with fewer parts but yet which fits standard-sized outboard motors. Another object is to provide an outboard motor tote which is rugged in construction, reliable in operation and requires no rigid plate member below the lifting handle but still provides a comfortable grip when the motor tote is placed under tension as the weight of the motor is transferred to the handle.

Another object is to provide an improved strap-style outboard motor tote in which the straps are automatically positioned properly when the handle is placed at the top of the motor. Another object is to provide a strap-style handle for an outboard motor tote in which straps yield slightly, e.g., by spreading out as the weight of the motor is transferred to the handle to provide additional resiliency.

These and other more detailed and specific objects of the present invention will be better understood by reference to the following figures and detailed description which illustrate by way of example but a few of the various forms of the invention within the scope of the appended claims.

THE FIGURES

SUMMARY OF THE INVENTION

The invention provides an article carrier for a heavy article such as an outboard motor which includes a pair of downwardly extending article-encircling loops of strap material including a rear strap loop for encircling the stern portion of the outboard motor and a front strap loop encircling the front portion of the motor. Each of the straps is positioned during use in an inclined plane such that the rear strap loop projects rearwardly from the handle at an oblique angle and the front strap loop projects forwardly at an oblique angle whereby the straps lie in inclined planes that encircle the motor obliquely when in place on the motor housing. Preferably a handle is connected to the top of the loops of strap material. The handle is preferably a strap-style handle formed from an elongated flexible member which is connected to the article-encircling straps where they are joined at the top of the motor during use to provide a comfortable gripping surface for the hand. Releasable fasteners are secured to each of the loops for holding the straps in place around the motor during use.

The strap assembly includes a tension-absorbing connecting portion where the article-encircling loops are connected together at the top of the strap assembly, which can either be the top portion of the straps themselves at a point where they are joined together or a separate strong, flexible connecting element such as a piece of fabric webbing that is connected to upper portions of the article-encircling straps for holding them in place at the top of the motor. The connecting portion of the article carrier is aligned, i.e., parallel with the top portions of the loops of strap material.

While the invention can be used for carrying a variety of heavy objects, it is particularly useful for supporting, carrying, and positioning an outboard motor when the motor is being mounted or removed from the transom of a boat. For convenience, the invention will be described in connection with an outboard motor, but it should be understood that it can be used for other purposes such as the loading of heavy articles onto a boat or other vehicle.

DETAILED DESCRIPTION OF THE INVENTION

Figure 1:
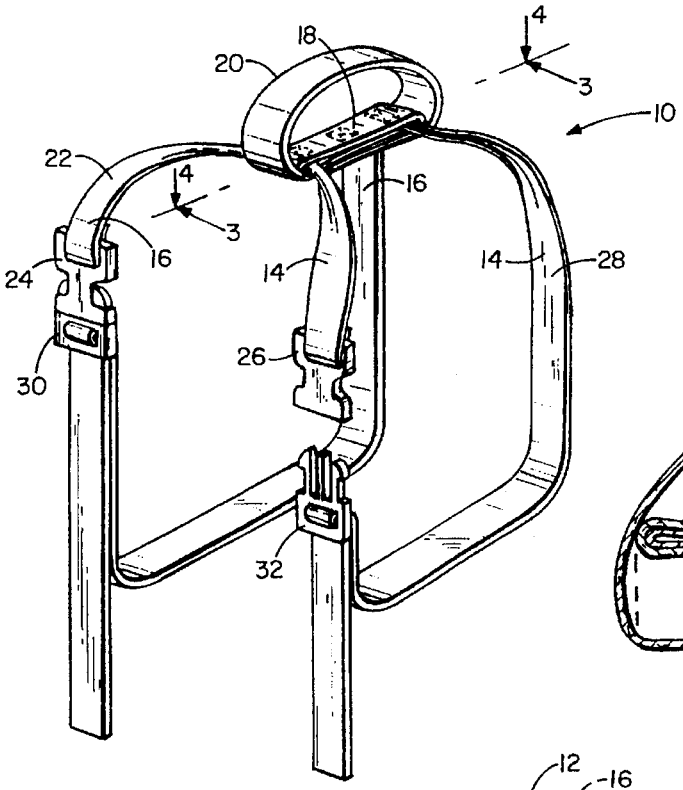
FIG. 1 is a diagrammatic perspective view showing one embodiment of the present invention.
Figure 2:
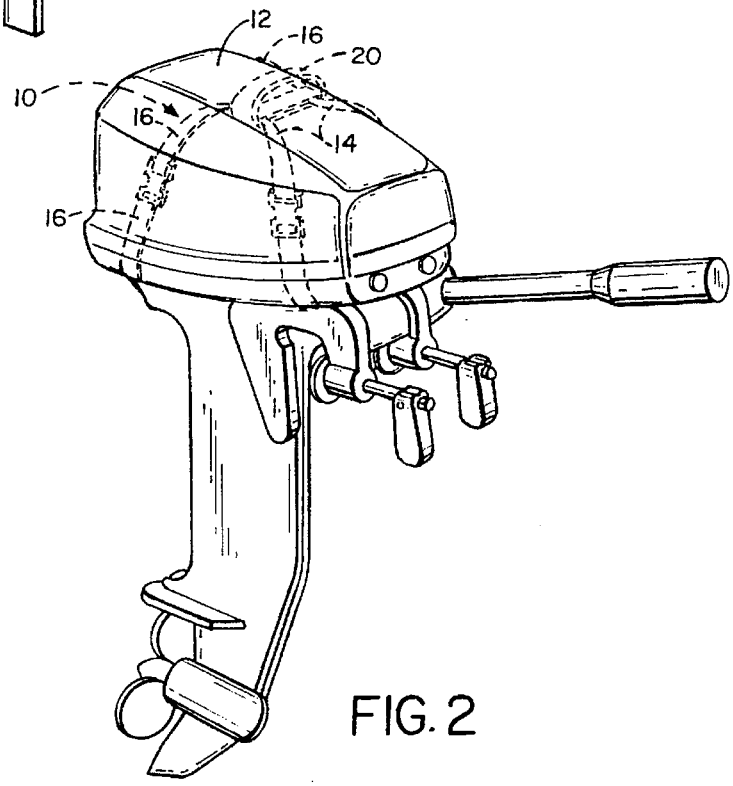
FIG. 2 is a perspective view showing the invention connected to an outboard motor as it appears during use.

As shown, especially in FIGS. 1 and 2, the article carrier indicated generally by the numeral 10 is illustrated by way of example for carrying an outboard motor 12. A handle 20 is preferably provided at the top of the article carrier 10. The article carrier 10 includes a pair of inclined loops of strap material including a front article-encircling loop 14 and a rear article-encircling loop 16 which are illustrated diagrammatically in a vertical position in FIG. 1 but which, during actual use, are inclined at an oblique angle and are placed during use so as to locate the handle 20 at the top of the housing of the motor 12 when the motor is in an upright position. It will be noted that the loops 14, 16 are inclined such that the rear loop 16 projects rearwardly from the handle 20 and is thus inclined at an oblique angle proceeding downwardly from the handle 20 while the front loop 14 projects forwardly from the handle 20 at an oblique angle inclined toward the front of the motor 12 during use so that the front loop 14 and rear loop 16 both lie flat against the motor housing when in place around the motor 12 during use.

The loops 14 and 16 are joined together at the top of the article carrier 10 by means of a flexible structural tension absorbing connecting element 18. The tension absorbing element 18 can be a part of the straps themselves as will be described in connection with FIGS. 5 and 6 or can be a separate piece 18 as shown in FIGS. 1–4.

The article-encircling loops 14, 16 of the strap assembly 10 in this instance are formed from a right strap and a left strap. The left strap is a relatively short piece of fabric webbing 22 about 13 inches long having fasteners 24, 26 connected to its ends and having a longitudinal fold line where it is folded in half against itself at its center as shown at **22*a*. The right strap 28 comprises a much longer piece, in this case about 88 inches long, having a longitudinal fold line where it is folded upon itself at 28*a* and is provided with fastener elements 30, 32 at its ends that mate with the fasteners 24 and 26, respectively. The longitudinal folds 22***a* and 28*a* are enclosed within a loop of fabric webbing about 11 inches long which forms the flexible connecting element 18 that is positioned during use to encircle the folds 22*a*, 28*a* and has ends that are overlapped at 18*a*. The entire assembly is then fastened together by means of stitching, in this case by box stitches shown at 40, 42 and 46 (FIG. 4) so as to securely connect the straps 22 and 28 to the flexible tension absorbing connecting element 18 at the top of the carrier 10.

Figure 3:
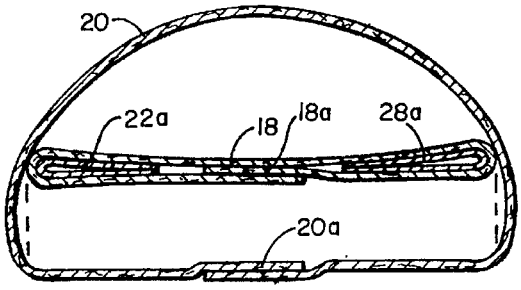
FIG. 3 is a vertical sectional view taken on line 3—3 of FIG. 1 on a larger scale.

A handle 20 that is formed from a piece of fabric webbing about 26 inches long which is folded into a loop with its ends overlapping and connected together by means of a lap joint 20*a* as shown in FIG. 3. The lap joint 20*a* is held together by the stitching 42 (FIG. 4) and is also held in place on the connecting element 18 by the box stitching at 40 and 46.

If desired, the bottom portions of the loops 14, 16 can be secured together by means of optional laterally spaced apart, longitudinally extending binder straps 41 and 43 (FIG. 5) which are connected between the lower portions of the strap loops 14, 16 on either side of the motor housing 12. The length of the binder straps 41, 43 is adjusted by means of suitable commercially available strap fasteners 44 and 45. The lateral binder straps 41, 43 can be used whenever the motor housing 12 is shaped in such a way that the strap loops 14, 16 may be liable to slip off its ends. This provides a secure means of preventing the lower portions of the loops 14, 16 from spreading apart, which if it occurred could allow the motor 12 to slip out of the strap assembly. Most motors will not require the optional binder straps 41, 43.

It was discovered that during use the folded portions 22*a*, 28*a* of the straps 22 and 28 formed flexible shock absorbing elements at the point adjacent to the handle 20 where the strap material spreads out over the surface of the top of the housing of the motor 12. It was noticed that, as the weight of the motor 12 is transferred to the handle 20 when the motor is being lifted, the folded strap material on either side of the handle 20 will stretch slightly, acting as a shock absorber as the webbing is drawn down against the top of the motor housing. It is important that the tension absorbing connecting element 18 or, in the embodiment of FIGS. 5 and 6 where the straps cross, is under tension during use because it serves to keep the space under the handle 20 open so that the hand can be easily inserted. The tension absorbing connecting element 18 under the handle 20 or 54, as the case may be, directs the load on each loop of strap material to a center point beneath the handle 20.

Figure 5:
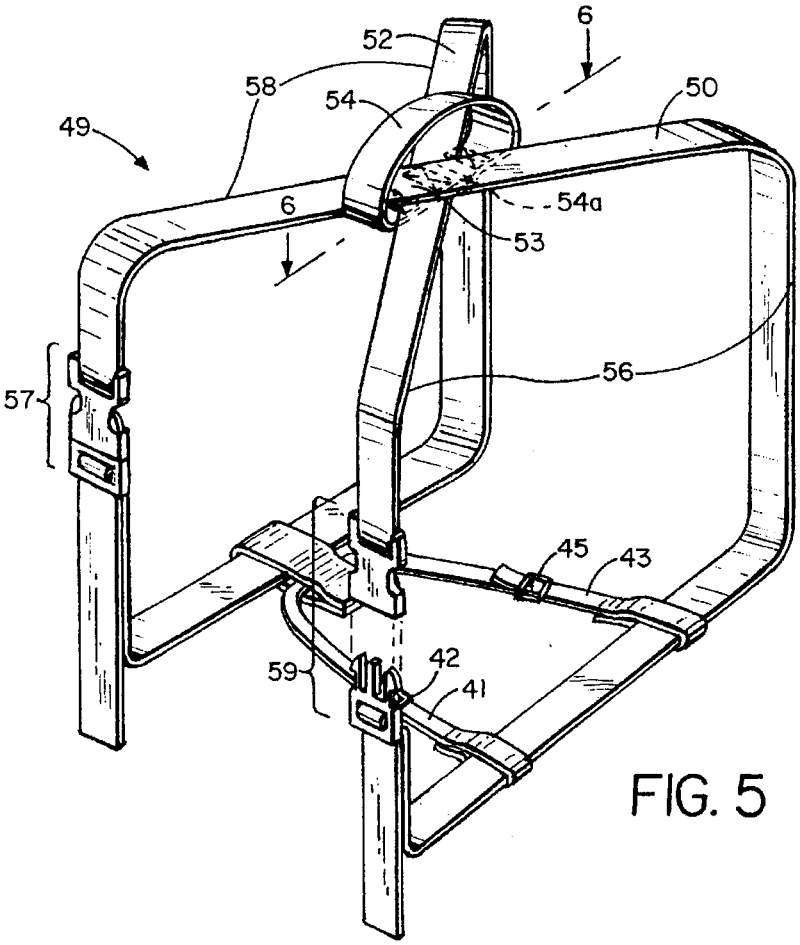
FIG. 5 is a diagrammatic perspective view of another embodiment of the present invention.
Figure 4:
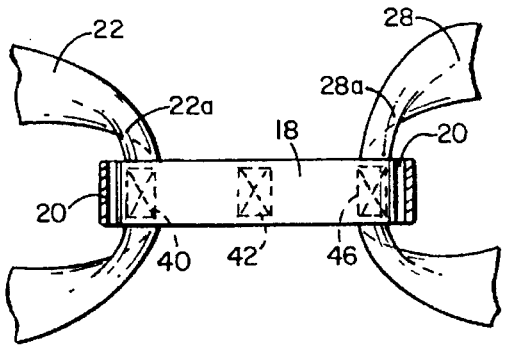
FIG. 4 is a horizontal sectional view taken on line 4—4 of FIG. 1 on a larger scale.
Figure 6:
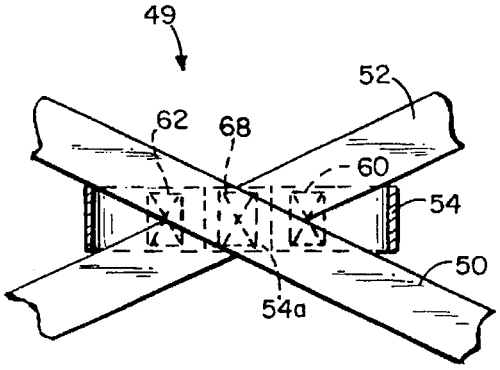
FIG. 6 is a horizontal cross-sectional view taken on line 6—6 of FIG. 5 on a larger scale.

Refer now to FIGS. 5 and 6 which illustrate another embodiment of the invention. The article carrier indicated generally at 49 includes a pair of straps 50 and 52 which intersect obliquely at a support point 53 which serves to absorb tension adjacent handle 54. It is at the support point 53 that the straps are enclosed within a loop of strap material which forms the handle 54. The intersecting straps 50 and 52 form a pair of strap loops including a front strap loop 56 and a rear strap loop 58 which are both inclined at an oblique angle on the motor 12 during use as already described in connection with FIGS. 1–4. Although the loops 56, 58 are shown in vertical planes, this has been done just for clarity of illustration. During use, the handle 54 is located at the top of the outboard motor 12 as previously described in connection with FIGS. 1–4. The top portion 53 of the straps 50 and 52 adjacent handle 54 serves a tension absorbing function at the top of carrier 49 for transferring the stress of the load across the top of the motor 12. Thus, the portion of the straps 50, 52 which intersect adjacent to the handle 54 can be thought of as a flexible, tension absorbing element at the top of the article carrier 49. The ends of the straps 50, 52 are connected together by means of commercially available buckles 57 and 59 to releasably connect the article carrier to the housing of the motor 12. The lateral binder straps 41, 43 can be used whenever the motor housing 12 is shaped in such a way that the strap loops 56 and 58 may be liable to slip off its ends.

The article carrier 49 is formed by positioning the straps 50, 52 at an oblique angle relative to one another of about 40 to 60 degrees and then holding them securely in position or, if desired, bonding them together to hold them in place. Next, the handle 54 which is composed of the same fabric webbing material as the straps is formed into a loop as shown in FIG. 5 so as to completely encircle the intersecting straps 50, 52 and its ends are overlapped at 54*a*. The entire assembly is then securely fastened together by means of stitching, for example by means of box stitches shown at 60, 62 and 68 in FIG. 6. The buckles 57, 59 can then be secured to the ends of the straps 50, 52.

While a variety of different strap materials can be employed, I have found that black polyester webbing 1½ inches wide can be employed for all of the straps 14, 16 and 50, 52 as well as the tension absorbing connecting element 18 and the handles 20 and 54. This will provide a strap assembly which is strong enough to support an outboard motor 12 typically weighing up to 200 pounds, allowing a 2-to-1 safety factor.

The present invention is relatively simple to construct and can be formed from as few as three pieces of strap material, or four pieces in the case of the embodiment of FIGS. 1–4. It is strong, rugged in construction, and will fit all standard size outboard motors. Moreover, no rigid plate is required as part of the handle. In addition, the handle will nevertheless not tend to pinch or close on the hand when the motor is being lifted. The invention is easy to mount on an outboard motor, and when placed on top of the motor the straps forming the loops that encircle the motor are automatically positioned on the sides of the motor. In addition, the folds 22*a*, 28*a* add resiliency to the article carrier. Finally, the lateral straps 41, 43 when employed will prevent the carrier from slipping off the motor housing when there is a tendency to do so. The crossed-loop structure of FIGS. 5 and 6 simplifies construction and is highly effective in concentrating the load at the central support point 53 of the article carrier 49 beneath the handle 54. The handle 20, 54 provides comfortable hand opening that does not squeeze the fingers together even when the loops of strap material are pulled tightly against the motor. In both the embodiments the lower portions of the strap material beneath the motor 12 are spaced apart by a substantial distance, and yet the strap material conforms neatly to the curved sides and top of the motor housing.

Many variations of the present invention within the scope of the appended claims will be apparent to those skilled in the art once the principles described herein are understood.

What is claimed is:

1. A carrier for a heavy article such as an outboard motor having a top portion, sides, a front, a rear, and a fore and aft axis, said carrier comprising, a strap means that has a pair of article-encircling loops of flexible strap material including a rear strap loop for encircling the rear of the article and a from strap loop encircling the from of the article, a hand grip member for providing a comfortable gripping surface, said hand grip member is supported upon the article-encircling loops of strap material at a top portion of the article during use to provide a hand grip for the carrier, each of said article-encircling loops of strap material is positioned during use in an inclined plane wherein the rear strap loop projects rearwardly from the hand grip member at an oblique angle and the front strap loop projects forwardly at an oblique angle whereby the strap loops lie in inclined planes and encircle the article obliquely when in place on the article such that the strap loops are spread apart at a bottom portion of the article, portions of the loops of strap material are together at the top of the carrier adjacent to the hand grip member, the portions of the loops of strap material that are together and said hand grip member are both oriented to lie across the top portion of said article so as to extend from one side thereof to the other side at right angles to the fore and aft axis thereof, releasable fastener means secured to at least one of the strap loops for holding the carrier in place on the article during use, and the hand grip member extends at least partially around an upper portion of the article-encircling loops where the loops pass over the top surface of the article that is being carded and the loops extend all the way from one side of the article across the top of the article and thence downwardly across an opposite side thereof.

2. The article carrier of claim 1 wherein the strap means is a single strap that includes said two loops of strap material and said single strap has portions that cross one another where the loops are together at the top of the carrier.

3. The article carrier of claim 2 wherein the hand grip member is formed from fabric material and is positioned adjacent to the portions of the strap that cross one another where the loops are together at the top of the carrier.

4. The article carrier of claim 1 wherein the hand grip member has edges that are connected together to encircle the portions of the strap that cross one another.

5. The article carrier of claim 1 wherein the article carrier comprises a flexible strap including both of said article-encircling loops of strap material including said front loop of strap material which extends across the top of the article that is being carded and said rear loop of strap material that extends across the top of the article and intersects the front loop of strap material, the article-encircling loops of strap material intersect one another at the top of the article carrier and the hand grip member is supported upon the intersecting portions of the article-encircling sections of strap material so as to facilitate lifting the article.

6. An article carrier for heavy articles such as an outboard motor having a from portion, a rear portion, a top and opposing sides comprising, at least one article-encircling strap having two loops therein including a rear strap loop for encircling the rear portion of the outboard motor and a front strap loop encircling the front portion of the motor, a handle formed from a grip member is mounted upon the article-encircling strap at the top of the motor during use to provide a hand grip for the carrier, said article-encircling loops being positioned during use in inclined planes such that the rear strap loop projects rearwardly from the handle at an oblique angle and the front strap loop projects forwardly at an oblique angle whereby the loops lie in inclined planes and encircle the motor obliquely when in place on the motor, releasable fastener means secured to at least one of the strap loops for securing the carrier in place on the motor during use, the article-encircling loops include a first strap loop portion that extends across the top of the article being carded and a second strap loop portion that extends across the top of the article being carded, and said first and second strap loop portions intersect one another at the top of the article carrier for defining a support point for lifting the article that is to be carded with the handle supported thereon.

7. The article carrier of claim 6 wherein the handle extends across the article from one side to the other in alignment with the loops.

8. The article carrier of claim 6 wherein the handle is formed from flexible material and is connected to the support point at the top of the article carrier where the strap loops intersect one another to provide a smooth hand-engaging surface to facilitate lifting the article.

9. The article carrier of claim 8 wherein the handle member is a piece of fabric, and the piece of fabric is positioned to encircle the portions of the strap loops that intersect one another.

10. The article carrier of claim 6 wherein the handle comprises a piece of fabric encircling portions of strap material and the handle is supported thereby.

11. The article carrier of claim 6 wherein portions of the article-encircling loops both extend across the article from one side thereof to the other where the loops intersect one another at a support point of the article carrier.

12. The article carrier of claim 6 wherein a pair of longitudinally extending spaced apart lateral straps are connected between lower portions of the loops to prevent the lower portions of the loops from falling off the article that is being carded.

13. The article carrier of claim 6 wherein the article encircling strap is fabric webbing and the intersecting portions thereof are stitched together.

* * * * *

UNITED STATES PATENT AND TRADEMARK OFFICE

CERTIFICATE OF CORRECTION

PATENT NO. : 5,645,307

DATED : Jul. 8, 1997

INVENTOR(S) : WENGLER, James J.

It is certified that error appears in the above-indentified patent and that said Letters Patent is hereby corrected as shown below:

Col. 4, line 62 (claim 1), change "from" to ---front---.

Col. 5, line 42 (claim 5), change "carded" to ---carried---.

Col. 5, line 50 (claim 6), change "from" to ---front---.

Col. 6, line 23 (claim 6), change "carded" to ---carried---.

Col. 6, line 48 (claim 12), change "carded" to ---carried---.

Signed and Sealed this

Fourteenth Day of October, 1997

*Attest:*

*Attesting Officer*

BRUCE LEHMAN

*Commissioner of Patents and Trademarks*